US009838818B2

(12) United States Patent
Seligmann et al.

(10) Patent No.: US 9,838,818 B2
(45) **Date of Patent: *Dec. 5, 2017**

(54) IMMERSIVE 3D SOUND SPACE FOR SEARCHING AUDIO

(71) Applicant: Avaya Inc., Santa Clara, CA (US)

(72) Inventors: Doree Duncan Seligmann, New York, NY (US); Ajita John, Holmdel, NJ (US); Michael J. Sammon, Watchung, NJ (US)

(73) Assignee: Avaya Inc., Santa Clara, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 15/009,950

(22) Filed: Jan. 29, 2016

(65) Prior Publication Data

US 2016/0150340 A1 May 26, 2016

Related U.S. Application Data

(63) Continuation of application No. 13/728,467, filed on Dec. 27, 2012, now Pat. No. 9,301,069.

(51) Int. Cl.

| | |
|---|---|
| ***H04S 3/00*** | (2006.01) |
| ***H04R 27/00*** | (2006.01) |
| ***H04S 7/00*** | (2006.01) |

(52) U.S. Cl.

CPC ..... *H04S 3/002* (2013.01); *H04R 27/00* (2013.01); *H04S 7/40* (2013.01);

(Continued)

(58) Field of Classification Search

CPC ..... H04S 3/002; H04S 7/302; H04S 7/303; G06F 3/04815; G06F 17/30; G06F 17/30256; G10L 21/10

(Continued)

(56) References Cited

U.S. PATENT DOCUMENTS 5,736,982 A 4/1998 Suzuki et al.
5,768,393 A * 6/1998 Mukojima ..... H04S 1/007 381/17

(Continued)

FOREIGN PATENT DOCUMENTS

JP H07-44575 2/1995

OTHER PUBLICATIONS

Official Action for U.S. Appl. No. 13/728,467, dated Jun. 5, 2015, 8 pages.

(Continued)

*Primary Examiner* — Gerald Gauthier
(74) *Attorney, Agent, or Firm* — Sheridan Ross P.C.

(57) ABSTRACT

Systems, methods, and computer-readable storage media for generating an immersive three-dimensional sound space for searching audio. The system generates a three-dimensional sound space having a plurality of sound sources playing at a same time, wherein each of the plurality of sound sources is assigned a respective location in the three-dimensional sound space relative to one another, and wherein a user is assigned a current location in the three-dimensional sound space relative to each respective location. Next, the system receives input from the user to navigate to a new location in the three-dimensional sound space. Based on the input, the system then changes each respective location of the plurality of sound sources relative to the new location in the three-dimensional sound space.

18 Claims, 7 Drawing Sheets

(52) U.S. Cl.
CPC .. *H04R 2227/003* (2013.01); *H04R 2227/005* (2013.01); *H04S 2400/11* (2013.01)

(58) Field of Classification Search
USPC ..... 381/1, 17, 77, 92, 302, 303, 307, 309, 381/310; 382/103; 463/38, 31; 701/301, 701/533, 441; 345/419; 348/155; 379/201.1, 202.01; 455/406; 482/4; 700/94; 702/150; 703/6; 704/2, 260; 715/727, 849
See application file for complete search history.

(56) References Cited

U.S. PATENT DOCUMENTS 5,997,439 A * 12/1999 Ohsuga ..... A63B 71/0622 434/247
6,243,476 B1 * 6/2001 Gardner ..... H04S 1/007 381/1
6,404,442 B1 * 6/2002 Hilpert, Jr. ..... G06F 3/0481 715/700
6,469,712 B1 * 10/2002 Hilpert, Jr. ..... G06F 3/012 340/384.1
6,504,933 B1 * 1/2003 Chung ..... H04S 1/002 381/1
6,647,119 B1 * 11/2003 Slezak ..... G06F 3/011 345/619
6,845,338 B1 * 1/2005 Willins ..... G01C 21/20 340/988
7,308,325 B2 * 12/2007 Coles ..... G06F 3/167 381/17
8,639,214 B1 * 1/2014 Fujisaki ..... H04M 11/007 379/88.03
9,301,069 B2 * 3/2016 Seligmann ..... H04R 27/00
9,736,613 B2 * 8/2017 Osman ..... H04S 7/302
2002/0174121 A1 * 11/2002 Clemie ..... G06F 17/30256
2002/0175996 A1 11/2002 Porter et al.
2004/0174431 A1 * 9/2004 Stienstra ..... G06F 3/011 348/155
2004/0240652 A1 * 12/2004 Kanada ..... H04M 3/42365 379/201.1
2005/0222844 A1 * 10/2005 Kawahara ..... H04S 3/002 704/260
2005/0265535 A1 * 12/2005 Kanada ..... H04M 3/568 379/202.01
2006/0007308 A1 1/2006 Ide et al.
2006/0008100 A1 * 1/2006 Kim ..... H04S 5/02 381/309
2006/0008117 A1 * 1/2006 Kanada ..... H04S 7/302 382/103
2006/0045275 A1 * 3/2006 Daniel ..... G10H 1/0091 381/17
2006/0095453 A1 * 5/2006 Miller ..... G06F 21/6209
2006/0200769 A1 9/2006 Chevallier et al.
2006/0251263 A1 * 11/2006 Vronay ..... H04R 27/00 381/17
2008/0012850 A1 1/2008 Keating, III
2008/0123867 A1 * 5/2008 Yano ..... G10H 1/0066 381/77
2008/0133190 A1 6/2008 Peretz et al.
2008/0215239 A1 * 9/2008 Lee ..... G01C 21/3629 701/441
2009/0164122 A1 * 6/2009 Morbey ..... G08G 5/0021 701/301
2009/0251459 A1 * 10/2009 Navarro Valiente .... A63F 13/12 345/419
2009/0286600 A1 11/2009 Hideya
2009/0305787 A1 * 12/2009 Ikejiri ..... A63F 13/06 463/38
2010/0097375 A1 4/2010 Tadaishi et al.
2011/0066365 A1 * 3/2011 Khawand ..... G01C 21/3629 701/533
2011/0078173 A1 3/2011 Seligmann et al.
2011/0138991 A1 6/2011 Tsuchida
2012/0022842 A1 * 1/2012 Amadu ..... H04S 7/30 703/6
2012/0051568 A1 * 3/2012 Kim ..... H04R 1/403 381/307
2012/0070005 A1 * 3/2012 Inou ..... H04S 1/002 381/17
2012/0076305 A1 * 3/2012 Virolainen ..... H04M 3/568 381/17
2012/0183161 A1 * 7/2012 Agevik ..... H04S 7/302 381/303
2012/0269351 A1 10/2012 Sato
2012/0308056 A1 * 12/2012 Nakayama ..... B60Q 9/008 381/302
2013/0007604 A1 1/2013 John et al.
2013/0041648 A1 * 2/2013 Osman ..... H04S 7/304 704/2
2013/0083941 A1 4/2013 Rogel et al.
2013/0141587 A1 6/2013 Petricoin, Jr.
2013/0208897 A1 8/2013 Vincent et al.
2014/0010391 A1 * 1/2014 Ek ..... G06F 3/011 381/310
2014/0157206 A1 * 6/2014 Ovsiannikov ..... G06F 3/0485 715/849
2014/0171195 A1 * 6/2014 Searchfield ..... A63F 9/0001 463/31
2014/0185823 A1 * 7/2014 Seligmann ..... H04R 27/00 381/92
2016/0150340 A1 * 5/2016 Seligmann ..... H04R 27/00 381/1
2017/0038943 A1 * 2/2017 Seligmann ..... H04R 27/00
2017/0040028 A1 * 2/2017 Seligmann ..... H04R 27/00
2017/0041730 A1 * 2/2017 Seligmann ..... H04S 7/303

OTHER PUBLICATIONS

Notice of Allowance for U.S. Appl. No. 13/728,467, dated Nov. 16, 2015, 8 pages.
Notice of Allowance for U.S. Appl. No.15/296,238, dated Oct. 3, 2017, 9 pages.
Notice of Allowance for U.S. Appl. No. 15/296,883, dated Jul. 14, 2017, 12 pages.

* cited by examiner

IMMERSIVE 3D SOUND SPACE FOR SEARCHING AUDIO

PRIORITY INFORMATION

The present application is a continuation of U.S. patent application Ser. No. 13/728,467, filed Dec. 27, 2012, the contents of which is incorporated herein by reference in its entirety.

BACKGROUND

1. Technical Field

The present disclosure relates to three-dimensional sound spaces and more specifically to generating an immersive three-dimensional sound space for audio searching.

2. Introduction

A typical computer-supported search returns a list of hits, ranked and ordered, based on the particular search query. In addition, the search result often includes other information, such as links and descriptive summaries. This type of search is generally appropriate for textual content. For example, a search of textual content can be performed through an Internet search engine to obtain a list of text hits ranked according to specific criteria specified by the user and the search engine. Similarly, an online library service search may be performed to obtain a list of articles or books, which may be ranked and ordered according to their similarity to the text in the search query.

Similar searching techniques can also be applied to search video and image content. For example, a search of videos or images can be performed to obtain a list of videos or images matching the search criteria. The videos in a video search can be rendered with an image of a single frame or a short segment for each video. The user can identify the desired video based on the image rendered for that video. Moreover, the images in an image search can be rendered as a grid of thumbnails. Here, the user can identify the desired image based on the thumbnail associated with that image.

Audio files can also be searched in a similar way. For example, audio files can be searched based on a text query to help a user identify relevant audio files. The text query can match with content of the audio file, or some metadata associated with the audio file, such as a participant's name, a subject, a date, or a tag. Here, the search can produce a list or table of audio files ranked and ordered by relevance. The user can then identify the audio files based on the text description. The user can also listen to the audio in an audio file from the search results to help identify the audio file. To listen to the audio in an audio file, the user must click or select the audio file to activate it and initiate audio playback. However, this process can be terribly inefficient, as users have to play each audio file separately to listen to the audio in the file. Yet users may often have to listen to an audio file to be able to correctly identify the audio file. Thus, searching the audio files based on a textual query often does not allow the user to sufficiently identify the desired audio file. However, as the number of audio files to search increases, the process of playing and listening to each audio file separately can become significantly onerous.

SUMMARY

Additional features and advantages of the disclosure will be set forth in the description which follows, and in part will be understood from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and non-transitory computer-readable storage media for generating an immersive three-dimensional sound space for audio searching. The system generates a three-dimensional sound space having a plurality of sound sources playing at a same time, wherein each of the plurality of sound sources is assigned a respective location in the three-dimensional sound space relative to one another, and wherein a user is assigned a current location in the three-dimensional sound space relative to each respective location. In some embodiments, the system can first receive a search request from the user to search for sound sources and identify the sound sources based on the search criteria in the search request. The system can then generate the three-dimensional sound space based on the sound sources.

The plurality of sound sources can include an audio file, a live communication session, a recorded conversation, etc. The three-dimensional sound space can be based on a three-dimensional particle system, for example. Moreover, the three-dimensional sound space can be generated using three-dimensional audio spatialization to allow audio from multiple sound sources playing at a same time to be separated in space through sound localization. Here, the three-dimensional audio spatialization can create the famous cocktail party effect from the multiple sound sources, allowing the user to listen to multiple sound sources at once and, at the same time, recognize each sound source.

Moreover, each respective location can be assigned to a respective sound source from the plurality of sound sources based on a relationship between the plurality of sound sources. For example, the sound sources can be assigned locations based on their differences, their similarities, their relative relevance to the user, their ranking, their age, their associated date, their topic(s), and/or other factors. The plurality of sound sources can also be arranged based on groupings. The groupings can be based on a topic, a relevance, a search request, an association, a term, a ranking, a context, content, etc. The plurality of sound sources can dynamically self-arrange into groups as the user navigates and/or searches the three-dimensional sound space.

Next, the system receives input from the user to navigate to a new location in the three-dimensional sound space. The new location can be a virtual location within the three-dimensional sound space or a new three-dimensional sound space. The system can receive the input via a mouse, a touch screen, a touchpad, a keyboard, a camera, a photo-capture device, a voice-input device, a motion capture device, a system state, a device state, a sensor, a joystick, a software control, a control pad, an external event, etc. Moreover, the input can be text, audio, a gesture, a movement, a selection, a click, a motion, a command, an instruction, an event, a signal from an input device, etc. For example, the user can use a control device, such as a joystick, to navigate to the new location in the three-dimensional sound space. As another example, the user can navigate to the new location by physically moving in the direction of the new location as perceived by the user in the three-dimensional sound space.

Based on the input, the system then changes each respective location of the plurality of sound sources relative to the new location in the three-dimensional sound space. The system can dynamically arrange the plurality of sound sources based on the new location to simulate the user's movement through the three-dimensional sound space. For the user, such dynamic arrangement can create the perception that the user has navigated the three-dimensional sound space. As the user navigates the three-dimensional sound space, the plurality of sound sources can be dynamically arranged based on groupings, categories, rankings, context, ratings, relevance, similarities, etc. For example, the plurality of sound sources can be dynamically arranged according to groupings based on a topic, a relevance, a search request, an association, a term, content, and so forth.

In some embodiments, the system can receive a user selection of a sound source from the three-dimensional sound space and generates a new three-dimensional sound space based on sound sources related to the selected sound source. Here, the sound sources can be assigned locations relative to one another, and the user can be assigned a location relative to the sound sources and associated with the sound source. For example, the user can select a sound source from the three-dimensional sound space, and the system can then generate a new three-dimensional sound space having sound sources that are relevant to the sound source selected by the user. The sound sources in the new three-dimensional sound space can be arranged or grouped based on one or more factors, such as similarities, differences, age, topics, rankings, ratings, etc. The user can select the sound source from the three-dimensional sound space by moving toward the sound source in the three-dimensional sound space, clicking on a graphical representation of the sound source in an interface, navigating towards the sound source using a navigation device or button, gesturing to select the sound source, etc.

In other embodiments, the system can receive a user selection of a sound source from the three-dimensional sound space and update the three-dimensional sound space based on the sound sources related to the selected sound source. In yet other embodiments, the system can use a three-dimensional particle system to dynamically lay out and order the plurality of sound sources in the three-dimensional sound space. The respective locations of the plurality of sound sources can be based on their relationships to the various search objects the user has selected. Thus, the three-dimensional sound space can act like a faceted search system. However, in some aspects, the objects in the three-dimensional sound space are not removed from the three-dimensional sound space as search terms are introduced. Instead, the objects can move towards the terms that they are associated with, and those objects with no associations can fall to the ground. This self-arrangement can represent relationships between the content objects and the search objects and allow the user to listen to similarities (if there are any) of the objects that are grouped together.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are described in detail below. While specific implementations are described, it should be understood that this is done for illustration purposes only. Other components and configurations may be used without parting from the spirit and scope of the disclosure.

The present disclosure provides a way to generate an immersive three-dimensional sound space. A system, method and computer-readable media are disclosed which generate an immersive three-dimensional sound space for audio searching. A brief introductory description of a basic general purpose system or computing device in FIG. 1, which can be employed to practice the concepts, is disclosed herein. A more detailed description and variations of generating an immersive three-dimensional sound space will then follow. These variations shall be described herein as the various embodiments are set forth. The disclosure now turns to FIG. 1.

Figure 1:
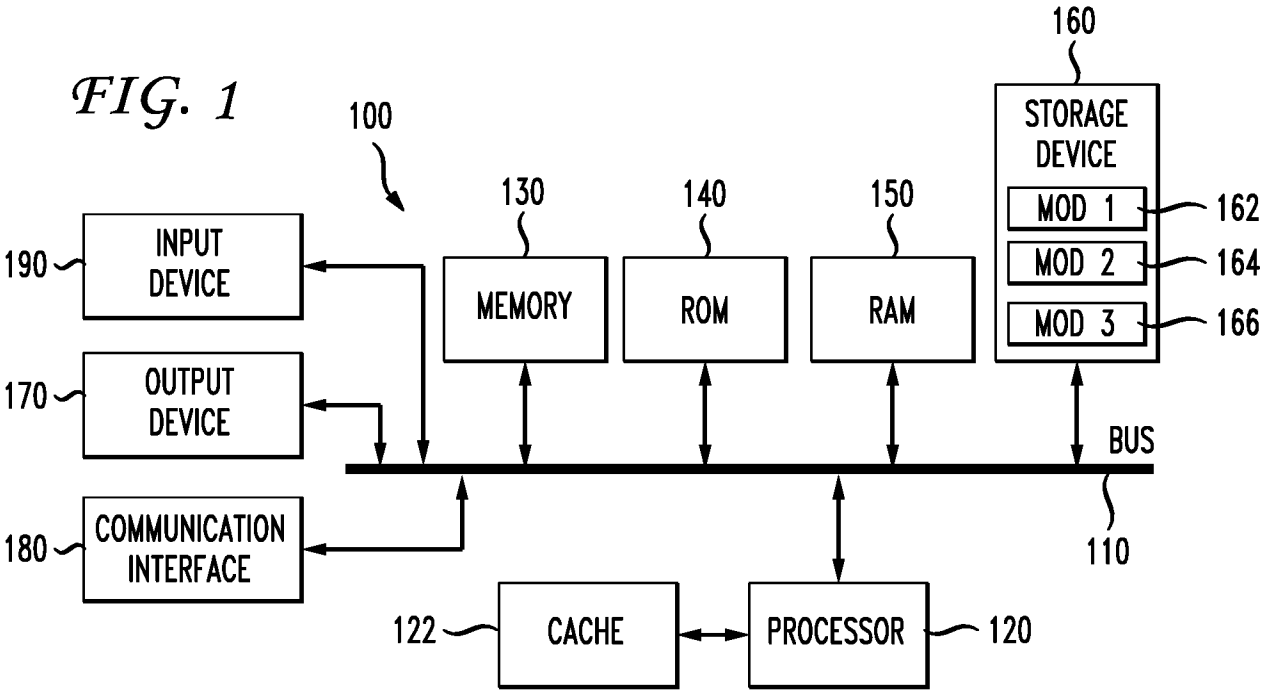
FIG. 1 illustrates an example system embodiment.

With reference to FIG. 1, an example system includes a general-purpose computing device 100, including a processing unit (CPU or processor) 120 and a system bus 110 that couples various system components including the system memory 130 such as read only memory (ROM) 140 and random access memory (RAM) 150 to the processor 120. The computing device 100 can include a cache 122 of high speed memory connected directly with, in close proximity to, or integrated as part of the processor 120. The computing device 100 copies data from the memory 130 and/or the storage device 160 to the cache 122 for quick access by the processor 120. In this way, the cache provides a performance boost that avoids processor 120 delays while waiting for data. These and other modules can control or be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer-readable storage media provide nonvolatile storage of computer-readable instructions, data structures, program modules and other data for the computing device 100. In one aspect, a hardware module that performs a particular function includes the software component stored in a tangible computer-readable storage medium in connection with the necessary hardware components, such as the processor 120, bus 110, display 170, and so forth, to carry out the function. In another aspect, the system can use a processor and computer-readable storage medium to store instructions which, when executed by the processor, cause the processor to perform a method or other specific actions. The basic components and appropriate variations are contemplated depending on the type of device, such as whether the computing device 100 is a small, handheld computing device, a desktop computer, or a computer server.

Although the example embodiment described herein employs the hard disk 160, other types of computer-readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the example operating environment. Tangible computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations described below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The computing device 100 shown in FIG. 1 can practice all or part of the recited methods, can be a part of the recited systems, and/or can operate according to instructions in the recited tangible computer-readable storage media. Such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored in other computer-readable memory locations.

Figure 2:
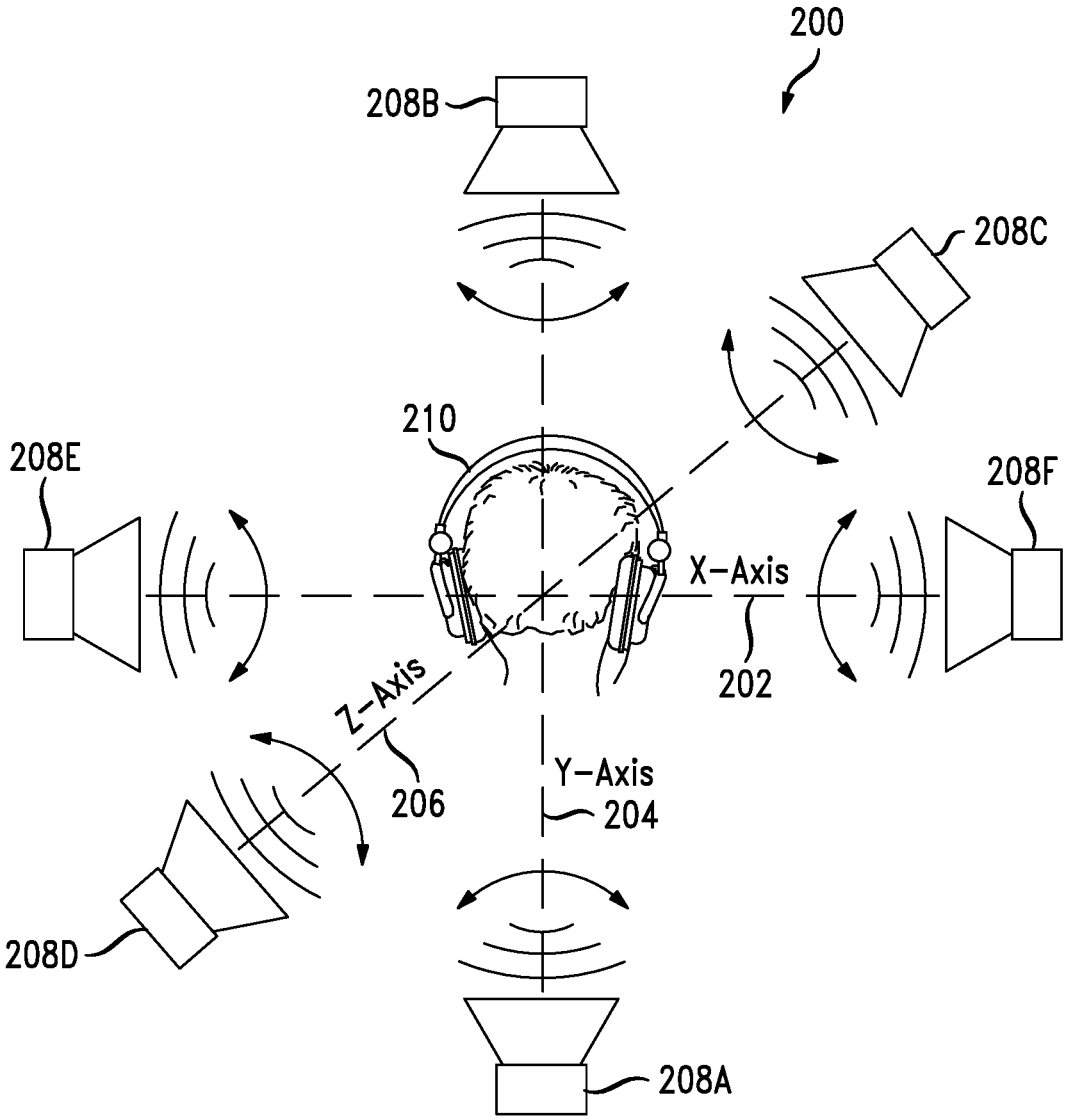
FIG. 2 illustrates an example three-dimensional reference coordinate system for a three dimensional sound space.

Having disclosed some components of a computing system, the disclosure now turns to FIG. 2, which illustrates an example three-dimensional reference coordinate system 200 for a three-dimensional sound space. The three-dimensional reference coordinate system 200 includes an X-axis 202, a Y-axis 204, and a Z-axis 206. Each axis represents a dimension of sound. In particular, the X-axis 202 represents the width, the Y-axis 204 represents the height, and the Z-axis 206 represents the depth. The three-dimensional reference coordinate system 200 can include sound sources 208A-F that provide sound at each of the three dimensions 202, 204, and 206. For example, sound sources 208A and 208B can provide sound along the vertical plane, Y-axis 204. By contrast, sound sources 208E and 208F can provide sound along the horizontal plane, X-axis 202. In some embodiment, the same sound source can provide sound along multiple dimensions. Indeed, the same sound source can provide sound along all three dimensions 202, 204, and 206. Moreover, each dimension can be mapped to an axis. Dimensions can be mapped to axes based on the sound sources 208A-F, metadata, external information about the sound sources 208A-F, etc.

In FIG. 2, the user 210 can perceive the sound from sound source 208A to originate from an area below the user 210. The user 210 can also perceive the sound from sound source 208B to originate from an area above the user 210. Moreover, the user 210 can perceive the sound from sound sources 208E and 208F to originate from an area to the left and right, respectively, of the user 210. Finally, the user 210 can perceive the sound from sound sources 208C and 208D to originate from an area in front and behind, respectively, of the user 210. This way, the user 210 can experience sound from all three dimensions within the three-dimensional reference coordinate system 200. The user 210 can experience the sound from the various dimensions using any output device, such as a mobile device, an augmented reality device, a gaming system, a smart television, computerized glasses, a tablet computer, a smartphone, etc.

Figure 3:
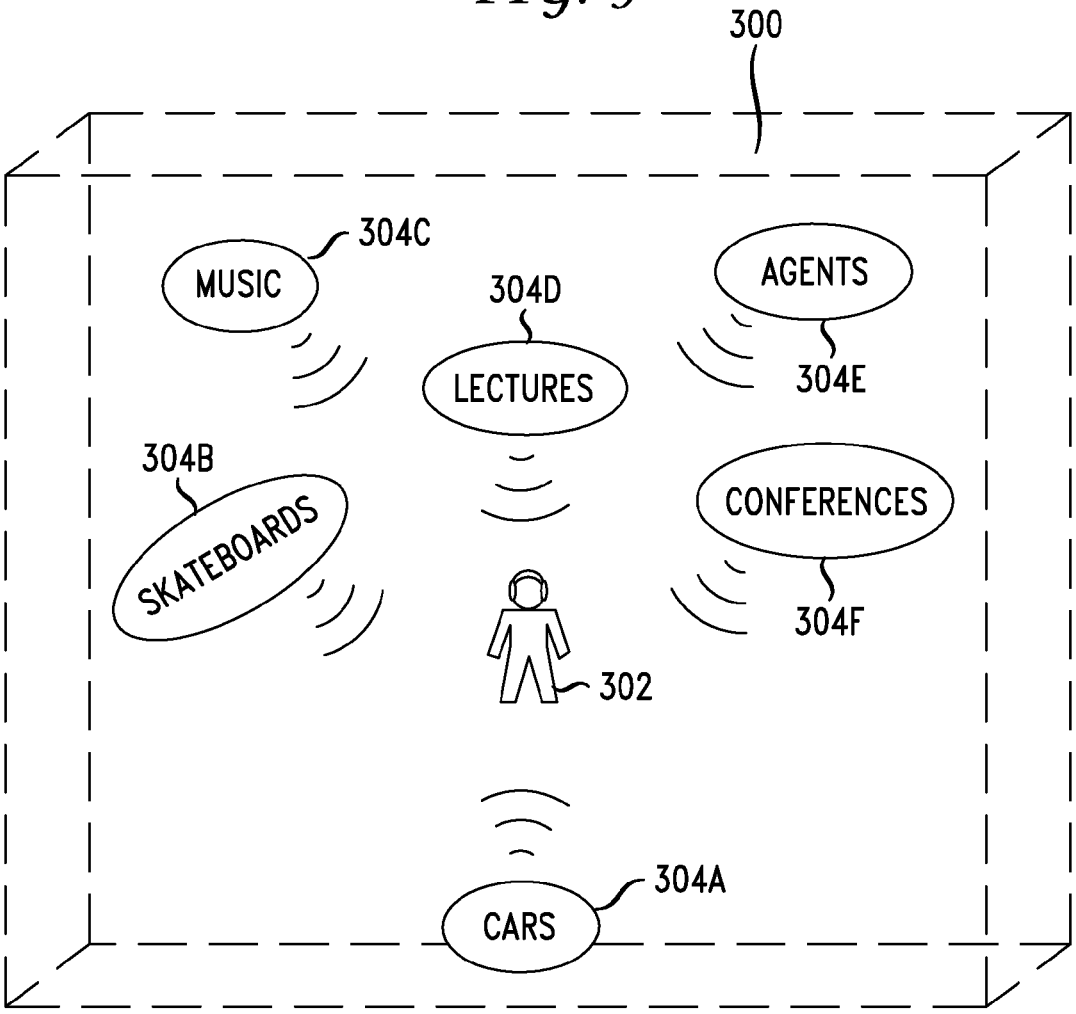
FIG. 3 illustrates an example three-dimensional sound space for searching audio.

FIG. 3 illustrates an example three-dimensional sound space 300 for searching audio. The three-dimensional sound space 300 is a virtual sound space that provides the user 302 with sound from three dimensions. However, in some embodiments, the virtual sound space can include less or more than three dimensions. For example, the virtual sound space can be a four-dimensional sound space. The virtual sound space can depict a four-dimensional view of various sound sources. The user 302 can browse, search, navigate the three-dimensional sound space 300 using any output device, such as a mobile device, an augmented reality device, a gaming system, a smart television, computerized glasses, a tablet computer, a smartphone, etc. The three-dimensional sound space 300 can include sound sources 304A-F located at specific locations relative to one another, within the three-dimensional sound space 300. The sound sources 304A-F can include audio recordings, audio files, and/or live inputs, for example. Moreover, the sound sources 304A-F can be stationary, or can also move within the three-dimensional sound space 300. Also, the dimensions in the three-dimensional sound space 300 can be mapped to axes based on external information about the sound sources 304A-F, for example. An apparent location of the user 302 in the three-dimensional sound space 300 can be used to determine the distance of the user 302 from the sound sources 304A-F.

The three-dimensional sound space 300 can use audio spatialization to allow the user 302 to listen to all of the sound sources 304A-F at the same time, in a manner that the sound sources 304A-F are distinguishable to the user 302, based on the respective locations of the sound sources 304A-F. This way, the three-dimensional sound space 300 can play all sound sources 304A-F at the same time and the user 302 can recognize each of the sound sources 304A-F. This can create what is known as the cocktail effect, where the user 302 can hear the closer sound sources more clearly, but can still faintly recognize the sound sources that are farthest away from the user 302. The audio spatialization can be generated using a particle system to map the spatial trajectories of sound.

The three-dimensional sound space 300 can also provide stereophonic ("stereo") sound. For example, the three-dimensional sound space 300 can use two or more independent audio channels to create an illusion of directionality and sound perspective. Moreover, the three-dimensional sound space 300 can be enhanced with synthesized sound effects, comments, tags, metadata, visual effects, etc. For example, the three-dimensional sound space 300 can be enhanced with an applause to depict live events, or comments, such as "I love this song," to provide additional information about a sound source.

The three-dimensional sound space 300 can also include a visual component for displaying content, such as images, video, text, media, sound sources, dimensions, etc. For example, the sound sources 304A-F can provide additional visual cues, such as the pictures of speakers, pictures of graphs, images associated with a sound source, etc. In some embodiments, the three-dimensional sound space 300 can include a three-dimensional view of the sound sources 304A-F and any other relevant information. The three-dimensional sound space 300 can provide the three-dimensional view through any display device. The three-dimensional sound space 300 can provide the three-dimensional view of the sound sources 304A-F to allow the user to view a graphical representation of the three-dimensional sound space 300 and/or one or more of the sound sources 304A-F, while also listening to spatialized, three-dimensional audio. Moreover, the visual component of the three-dimensional sound space 300 can depict various facets, such as size, distance, location, identity, relationships, characteristics, direction, etc. In addition, the visual component can provide configuration options for the user, and/or a mechanism for changing aspects of the three-dimensional sound space 300. For example, the visual component can provide a mechanism for the user to change aspects of the playback, such as distort, equalizer settings, sound effects, etc.

The user 302 can move throughout the three-dimensional sound space 300 to bring different sound sources into focus. For example, the user 302 can move towards the skateboards source 304B to bring that source into focus. This way, the user 302 will be able to better listen to the skateboards source 304B. As the user 302 moves away from other sound sources, those sound sources can dim or fade as if the sound was coming from a farther distance. For example, as the user 302 moves towards the skateboards source 304B, the conferences source 304F and the agents source 304E can dim or fade. The user 302 can thus listen to all the sound sources 304A-F and browse the sound sources 304A-F by moving around in the three-dimensional sound space 300. The user 302 can move towards a source of interest by moving in the direction of the sound from the source.

For example, the user 302 can hear music coming from the sound source 304C in the three-dimensional sound space 300. If the user 302 is interested in listening to music, she can move in the direction of the music to move closer to the sound source 304C of the music. The user 302 can physically move in the direction of the music to move closer to the sound source 304C, or the user 302 can navigate to the sound source 304C using an input device, such as a joystick, a mouse, a keyboard, a touchscreen, a touchpad, a button, a remote, etc. The user 302 can also navigate the three-dimensional sound space 300 by making gestures and/or navigating a graphical representation of the three-dimensional sound space 300. For example, the user 302 can navigate to the sound source 304C by making a gesture indicating that the user 302 wants to navigate to the sound source 304C, and/or selecting a representation of the sound source 304C on a graphical user interface. Moreover, the navigation of the three-dimensional sound space 300 can be recorded, shared, and/or edited. For example, the navigation of the three-dimensional sound space 300 can be used to produce a playlist. Here, the content of the playlist can be based on the various sound sources that the user 302 navigates to, for example. The user 302 can then share the playlist and/or a recording of the navigation.

As the user 302 gets closer to the sound source 304C of the music, the music comes into focus. The user 302 can continue moving towards the sound source 304C until the music is in focus and/or at a level desired by the user 302. The user 302 can continue hearing audio from the other sound sources 304A-B and 304D-F. The sound level of the other sources can depend on the proximity of the sound sources relative to the user 302. Thus, the user 302 can hear a sound source louder and/or more clearly as the user 302 gets closer to the sound source. When the user 302 navigates to the sound source 304C, the three-dimensional sound space 300 can bring the sound source 304C into focus, but can also provide additional information about the sound source 304C and/or other sound sources related to the sound source 304C.

The three-dimensional sound space 300 can provide a faceted search with automated layouts. The automated layouts can be based on, for example, relationships between search hits, search terms, topics, attributes, filters, etc. The automated layout can provide grouping of sound sources for the user 302. Grouping of sound sources can be used to address large search spaces, for example. The user 302 can drill down search results to obtain additional information about the selected search results, which can be delivered to the user 302 through audio (e.g., text-to-speech) as if the user 302 is at the same location as the audio. The additional information can also be delivered as an entity in the three-dimensional sound space 300, such as a virtual agent. For example, the additional information can be delivered through a virtual agent that the user 302 perceives from the user's 302 right ear, for example. Further, the additional information, or a portion of the additional information, can be delivered through a display.

When the user 302 selects a sound source item, the three-dimensional sound space 300 can also bring-up a new search for the user 302. For example, when the user 302 selects a sound source representing an album, the three-dimensional sound space 300 can expand to bring-up a collection of songs associated with the album, which the user 302 can listen to, navigate, browse, search, copy, edit, share, etc. As another example, when the user 302 selects a sound source representing a song, the three-dimensional sound space 300 can expand to bring-up all of the songs by the same author.

While FIG. 3 is discussed with reference to one user, the same and/or similar concepts can apply to a group of users. For example, the three-dimensional sound space 300 can be searched, browsed, and/or navigated by a group of users. Here, the three-dimensional sound space 300 can consider an aggregate of the users' facets to determine relevance to the user for positioning sound sources. Moreover, the navigation of a group of users can be recorded, shared, edited, and/or combined into a playlist, for example.

Figure 4A:
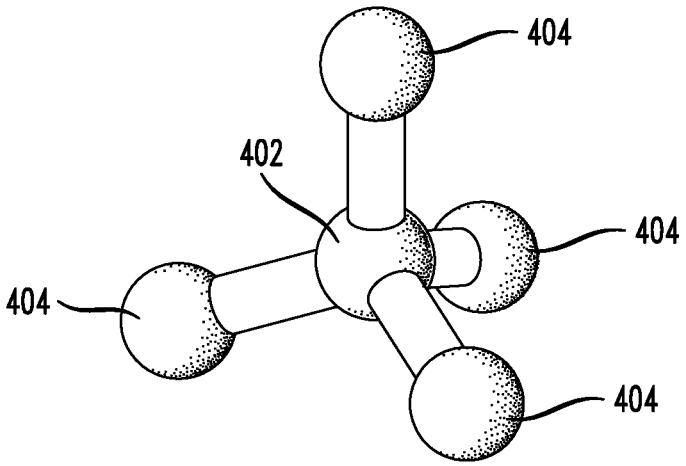
FIGS. 4A and 4B illustrate an example three-dimensional particle system.
Figure 4B:
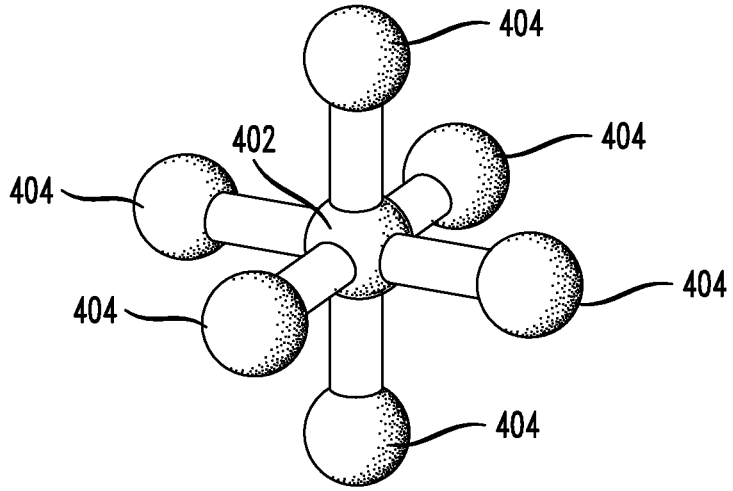

FIGS. 4A and 4B illustrate a particle system in three dimensions. Particle systems allow for easy programming of multiple factors simultaneously influencing audio effects in a sound space. Particle systems can be used to perform sound spatialization by mapping the various spatial trajectories of individual particles in the particle system to the spatial movement of individual, granular sounds. The particle system can be used to spatialize sound sources from other applications, recordings, and/or live inputs in real-time, for example. Spatialization can be used to clarify dense textures of sounds, choreograph complex audio trajectories, perceive greater number of simultaneous sound elements, etc.

A particle can be represented by a sound element, which, when combined with other similar particles, can create more natural and realistic sounds. Moreover, particles can themselves be particle systems. Each particle can have attributes and dynamics that can be assigned procedurally. The animation of a particle system can then be achieved by computing the behavior of each sound element.

In FIGS. 4A and 4B, lower weighted particles 404 surround a higher weighted particle 402. FIG. 4A only has 4 lower weighted particles 404, whereas FIG. 4B has 6 lower weighted particles 404. While the numbers of particles in a system can be quite large, these are shown only as basic examples of three-dimensional particle systems.

Figure 5:
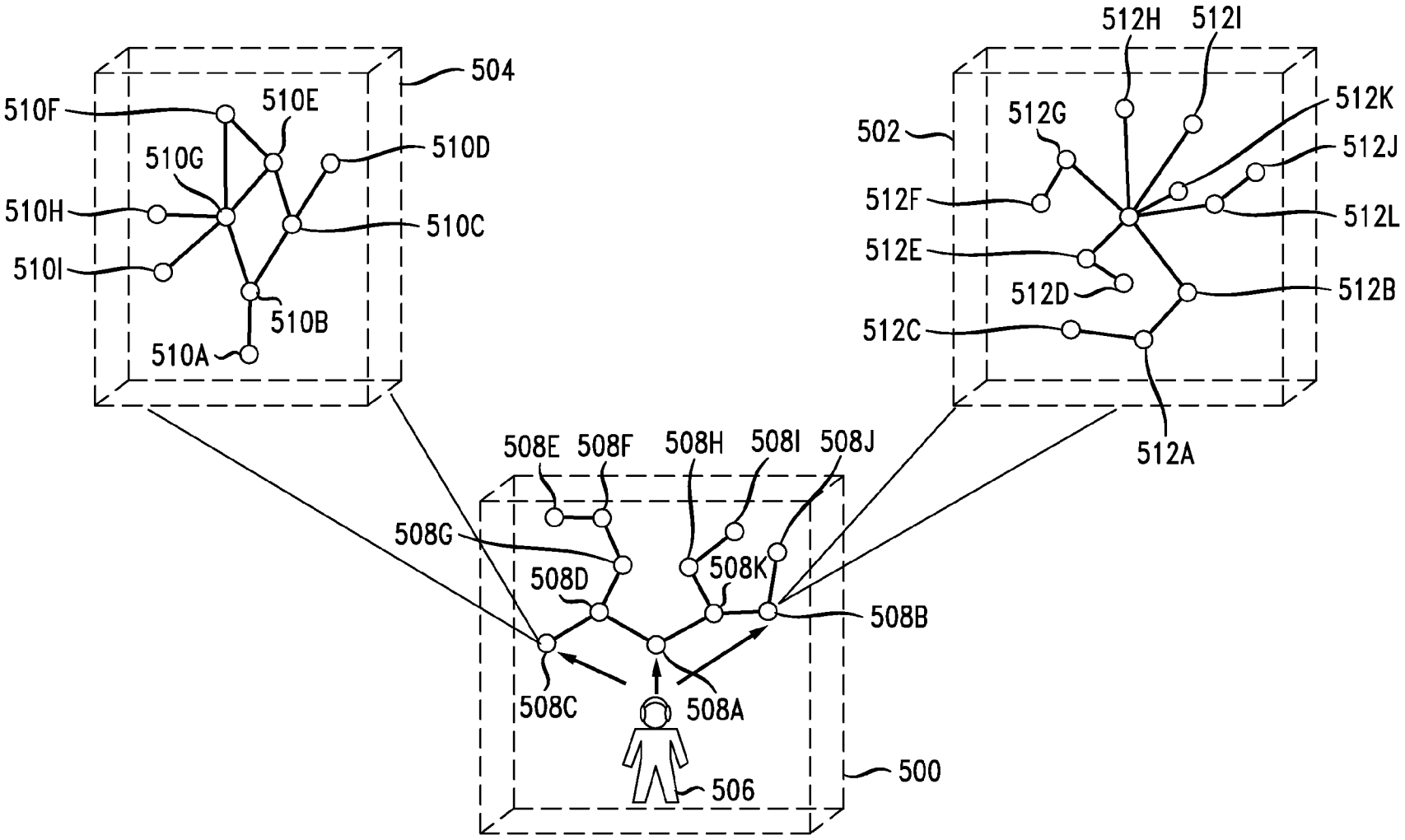
FIG. 5 illustrates an example three-dimensional particle system for arranging sound sources in a three-dimensional sound space.

FIG. 5 illustrates an example three-dimensional particle system for arranging sound sources in a three-dimensional sound space. The three-dimensional particle system can include particles 508A-K for spatializing sounds in a three-dimensional sound space 500. Each particle in the three-dimensional particle system can represent a sound source. With audio spatialization, the user 506 can perceive simultaneous sound elements from the sound sources represented by the particles 508A-K. The three-dimensional particle system maps the sound trajectories to provide the user 506 a realistic three-dimensional, virtual sound environment. The user 506 can perceive the virtual sound environment via any output device, such as a mobile device, an augmented reality device, a gaming system, a smart television, computerized glasses, three-dimensional glasses, a tablet computer, a smartphone, etc. The user 506 can browse through the sound sources by moving throughout the three-dimensional sound space 500. For example, the user 506 can bring a sound into focus by moving closer to the corresponding sound source. Similarly, the user 506 can dim a sound by moving away from the corresponding sound source.

A particle can itself be a particle system. For example, in FIG. 5, particles 508B and 508C are themselves particle systems. In particular, particle 508B is a three-dimensional particle system, which includes particles 512A-M. Particle 508C is also a three-dimensional particle system, which includes particles 510A-I. Thus, if user 506 moves toward a sound source represented by particle 508B, it can bring into focus the three-dimensional sound space 502, modeled by particles 510A-I. The user 506 then becomes immersed in the three-dimensional sound space 502, which allows the user 506 to perceive sound from the sound sources represented by particles 512A-M.

In some embodiments, particles 512A-M can be related to each other. Moreover, particles 512A-M can be related to particle 508B. For example, if particle 508B represents a sound source of lectures, the particles 512A-M in the three-dimensional particle system can represent different lectures. This way, the user 506 can navigate to a sound source and experience related sounds as the sound source expands to include additional, related sound sources. The related sound sources can self-arrange in a three-dimensional sound space 502 when the user 506 navigates to the sound source represented by particle 508B. The experience to the user 506 can be similar to selecting a category of sound sources and navigating the selected sound sources. The user 506 can also search sound sources and navigate the returned sound sources through a three-dimensional sound space.

Furthermore, if the user 506 moves toward the sound source represented by particle 508C, it can bring into focus the three-dimensional sound space 504, modeled by particles 510A-I. The user 506 then becomes immersed in the three-dimensional sound space 504, which allows the user 506 to perceive sound from the sound sources represented by particles 510A-I.

Figure 6:
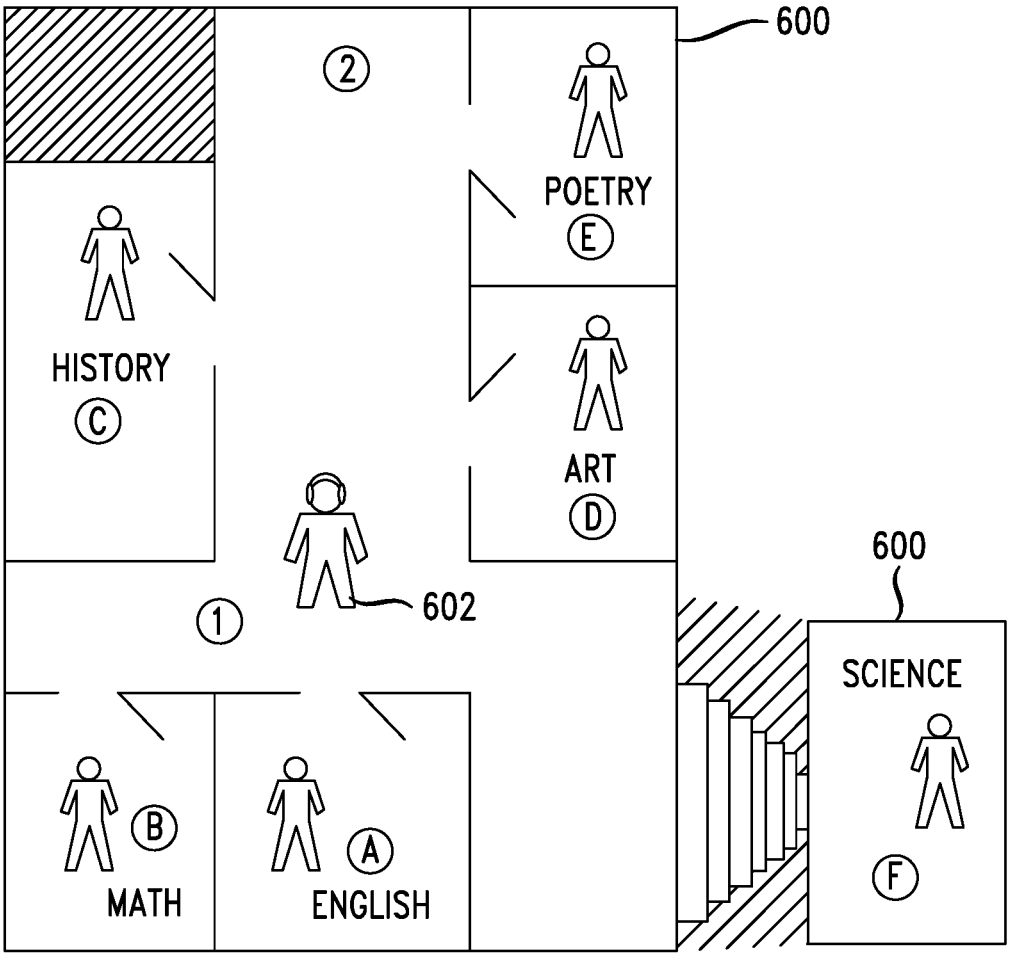
FIG. 6 illustrates an example user experience in a three-dimensional sound space with multiple sound sources.

FIG. 6 illustrates an example user experience in a three-dimensional sound space with multiple sound sources. Here, the user's experience navigating a three-dimensional sound space is illustrated by reference to what the user 602 perceives when navigating a college building 600. The college building 600 includes classrooms A-F. The classrooms A-F represent sound sources in a three-dimensional sound space, as each classroom generates sound in different dimensions, stemming from the professor's class lecture. Here, the user 602 is able to listen to the sound from the classrooms A-F at the same time. However, the sound perceived by the user 602 from the different classrooms will differ based on the proximity and/or location of the user 602 relative to the different classrooms. For example, when the user 602 is at position 1, she can perceive the lectures from classrooms A-D to be closer and/or more prominent, and the lectures from classrooms E and F farther and/or dimmer. Thus, the user 602 will be able to listen to the English, Math, History, and Art lectures from classrooms A-D, and at the same time will hear dimmer or faded poetry and science lectures from classrooms E and F.

Further, the user 602 can go inside a classroom to bring the lecture from that classroom into focus. For example, the user 602 can enter the classroom C to bring the history lecture into focus. This will cause the other lectures to fade out and/or dim. If the user 602 moves to position 2, she will affect the sound she perceives by changing her location relative to the different sound sources. For example, at position 2, the user 602 will be closer to the classroom E and farther away from the classrooms A and B than she was at position 1. Thus, by moving to position 2, the user 602 will bring the lecture from classroom E into focus, and will cause the lectures from classrooms A and B to fade out and/or dim. If interested in the poetry lecture, the user 602 can then enter the classroom E to listen to the poetry lecture. On the other hand, if the user 602 moves to position 3, she will bring the lecture from classroom F into focus and cause the other lectures to fade out and/or dim.

In this way, the user 602 can navigate the college building 600 to identify the different lectures and bring lectures into focus as desired. The user 602 moves around the college building 600 listening to all the lectures in the classrooms A-F, to identify a lecture of interest. Once the user 602 identifies a lecture of interest, she can bring that lecture into focus by moving closer to the corresponding classroom. If the user 602 then decides she wants to listen to that lecture, she can do so by entering the corresponding classroom.

The user 602 can also search for classrooms in the college building 600 and navigate the classrooms identified in the search. For example, the user 602 can look at a building directory to search for classrooms in the college building 600. The building directory can identify the location of the classrooms in the college building 600. The user 602 can then move to the location of those classrooms according to the building directory. This way, the user 602 can quickly find specific classrooms and go directly to those classrooms. From there, the user 602 can listen to the lectures in those classrooms and move/navigate through the building/classrooms to further narrow which lectures the user 602 wants hear.

Figure 7:
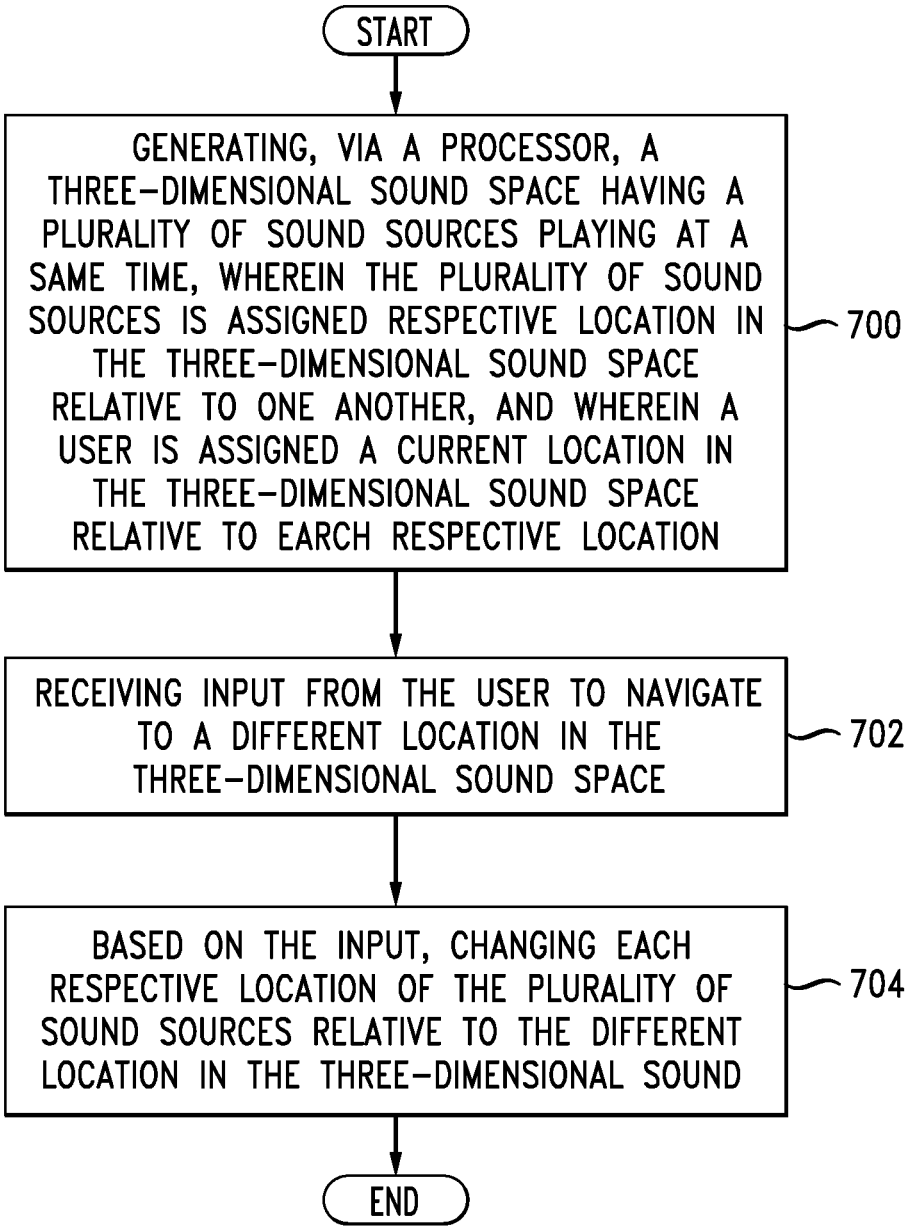
FIG. 7 illustrates an example method embodiment.

Having disclosed some basic system components and concepts, the disclosure now turns to the example method embodiment shown in FIG. 7. For the sake of clarity, the method is described in terms of example system 100, as shown in FIG. 1, configured to practice the method. The steps outlined herein are illustrative and can be implemented in any combination thereof, including combinations that exclude, add, or modify certain steps.

The system 100 generates a three-dimensional sound space having a plurality of sound sources playing at a same time, wherein each of the plurality of sound sources is assigned a respective location in the three-dimensional sound space relative to one another, and wherein a user is assigned a current location in the three-dimensional sound space relative to each respective location (700). The plurality of sound sources can include an audio file, a live communication session, a recorded conversation, etc. The three-dimensional sound space can be based on a three-dimensional particle system. Moreover, the three-dimensional sound space can be generated using three-dimensional audio spatialization to allow audio from multiple sound sources playing at a same time to be separated in space through sound localization. Spatialization can be used to clarify dense textures of sounds, choreograph complex audio trajectories, perceive greater number of simultaneous sound elements, etc. Thus, the three-dimensional audio spatialization can create what is widely known as the cocktail party effect from the plurality sound sources, allowing the user to listen to multiple sound sources at once, and, at the same time, recognize each sound source.

A three-dimensional particle system can be used to perform sound spatialization by mapping the various spatial trajectories of individual particles in the particle system to the spatial movement of individual, granular sounds. The three-dimensional particle system can be used to spatialize sound sources from other applications, recordings, sound sources, etc. The three-dimensional particle system can also be used to spatialize sound sources from live inputs in real-time, for example. A particle can be represented by a sound element (e.g., a sound source), which, when combined with other particles, can create more natural and realistic sounds. Also, particles can themselves be particle systems. Moreover, each particle can have attributes and dynamics that can be assigned procedurally, for example. The animation of a particle system can then be achieved by computing the behavior of each sound element.

In some embodiments, the three-dimensional sound space can create an immersive three-dimensional sound space through which users can navigate and issue search commands to better review search hits and find what they are looking for. Here, each of the plurality of sound sources is assigned a location in the three-dimensional sound space. Similarly, the user is also assigned a location in the three-dimensional sound space, and can control her position and navigate through the three-dimensional sound space. Audio spatialization can be used to create the cocktail party effect, which enables the user to listen to several conversations at once, and at the same time make each conversation out. Approaching a particular conversation object in the three-dimensional sound space can bring the conversation object into focus. Moreover, moving away from a conversation object can dim its audio just as walking away from a speaker in the real world would.

Each respective location in the three-dimensional sound space can be assigned to a respective sound source from the plurality of sound sources based on a relationship between the plurality of sound sources. For example, the plurality of sound sources can be assigned locations based on their differences, their similarities, their relative relevance to the user, their ranking, their age, their date, their topic(s), their rating, their level of detail and/or granularity, etc. The plurality of sound sources can also be assigned locations based on other factors, such as a user input, a history, a context, a preference, a rule, a setting, etc. Moreover, the plurality of sound sources can be arranged based on groupings. The groupings can be based on a topic, a relevance, a search request, a category, a level of detail, a ranking, a rating, a term, a title, a length, a creator, an identity, an age, an association, specific content, and/or other factors. Further, the plurality of sound sources can dynamically self-arrange based on an event and/or a trigger, such as a user input, a movement, a user gesture, a search request, a schedule, a calculation, a similarity, a threshold, an update, a selection, etc.

In some embodiments, the system 100 can first receive a search request from the user to search for sound sources, and identify the sound sources based on search criteria in the search request. The system 100 can then generate the three-dimensional sound space based on the sound sources identified in response to the search request. For example, the user can request the system 100 to search for lectures in a database of sound sources based on the search term "lectures." The system 100 can then search sound sources stored at the system 100 and/or a remote location for the term "lectures." The system 100 can also search any metadata associated with the sound sources for the term "lectures." The system 100 can then identify the sound sources matching the term "lectures," and generate the three-dimensional sound space based on the identified sound sources. This way, the system 100 can tailor the three-dimensional sound space based on the criteria supplied by the user. The system 100 can also arrange, order, and/or organize the sound spaces in the three-dimensional sound space according to a setting, a preference, a rule, a similarity, a relevance, a criteria, a ranking, a rating, an age, a user input, a history, a context, a topic, a level of detail and/or granularity, etc.

Next, the system 100 receives input from the user to navigate to a new location in the three-dimensional sound space (702). The system 100 can receive the input via a mouse, a touch screen, a touchpad, a keyboard, a camera, a photo-capture device, a voice-input device, a motion capture device, a system state, a device state, a sensor, an external event, a joystick, a software control, a remote, a navigation device and/or control, a button, etc. The input can be text, audio, a gesture, a movement, a selection, a click, an event, a signal from an input device, a command, a request, a query, an instruction, a motion, an input from a software control, etc. For example, the user can use an input device, such as a joystick, to navigate to the new location in the three-dimensional sound space. As another example, the user can navigate to the new location by physically moving in the direction of the new location, as perceived by the user in the three-dimensional sound space. Thus, the user can perceive the general direction of the new location relative to the user within the virtual sound space, and physically move in that direction to change the virtual location of the user in the three-dimensional sound space, with respect to the new location in the three-dimensional sound space.

In some embodiment, the user can navigate to the new location in the three-dimensional sound space by selecting a graphical representation of the new location in a graphical display. In other embodiments, the user can navigate to the new location in the three-dimensional sound space by pressing one or more buttons on a clickable control pad to instruct the system 100 to change the virtual location of the user relative to the plurality of sound sources and/or the new location. Here, the user can listen to the sounds from the plurality of sound sources, and use the clickable control pad to instruct the system 100 to move the virtual location of the user towards a sound source of interest to the user, as perceived by the user in the three-dimensional sound space.

Based on the input, the system 100 then changes each respective location of the plurality of sound sources relative to the new location in the three-dimensional sound space (704). The system 100 can dynamically arrange the plurality of sound sources based on the new location to simulate the user's movement through the three-dimensional sound space. For the user, this dynamic arrangement of sound sources can create the perception that the user has navigated the three-dimensional sound space and moved to the new location within the three-dimensional sound space. As the user navigates the three-dimensional sound space, the plurality of sound sources can dynamically self-arrange based on groupings, categories, rules, rankings, ratings, similarities, user input, context, metadata, size, sound quality, source type, etc. For example, the plurality of sound sources can dynamically self-arrange according to groupings based on a topic, a relevance, a search request, an association, a term, content, etc. The new location can be any virtual location within the three-dimensional sound space. Moreover, the new location can be a different three-dimensional sound space. Thus, by navigating to the new location, the user can navigate from one three-dimensional sound space to another three-dimensional sound space.

In some embodiments, the system 100 can receive a user selection of a sound source from the three-dimensional sound space and generates a new three-dimensional sound space based on sound sources related to the selected sound source. Here, the sound sources can be assigned locations relative to one another, and the user can be assigned a location relative to the sound sources and associated with the sound source. For example, the user can select a sound source from the three-dimensional sound space, and the system 100 can then generate a new three-dimensional sound space having other sound sources that are relevant to the sound source selected by the user. The sound sources in the new three-dimensional sound space can be arranged or grouped based on one or more factors, such as similarities, differences, age, topics, rankings, ratings, etc. The user can select the sound source from the three-dimensional sound space by moving toward the sound source in the three-dimensional sound space, clicking on a graphical representation of the sound source in an interface, navigating towards the sound source using a navigation device or button, gesturing to select the sound source, gesturing to indicate a motion towards the sound source, etc.

In other embodiments, the system 100 can use a three-dimensional particle system to dynamically layout and order the various audio recordings that are playing and audible in the three-dimensional sound space. The respective positions of the audio recordings can be based on their relationship to one or more search objects that the user has selected. The three-dimensional particle system can be rendered by the system 100 and displayed by the system 100 and/or any display device, such as a monitor, a tablet computer, three-dimensional glasses, a hologram projection, a smartphone, and a gaming system. Also, the distance between the user and the plurality of sound sources can be based on an apparent three-dimensional position of the user.

The three-dimensional sound space can act like a faceted search system. However, in some aspects, the objects in the three-dimensional sound space are not removed from the three-dimensional sound space as search terms are introduced. Instead, the objects move towards the terms that they are associated with, and those objects with no associations can fall to the ground. This self-arrangement can represent relationships between the content objects and the search objects, and allow the user to listen to similarities (if there are any) of the objects that are grouped together. For example, the user can easily detect a consistent tone in all the calls in the three-dimensional sound space that relate to complaints and a particular customer care agent. This arrangement also allows the user to browse through the sounds in the three-dimensional sound space that relate to the different customer care agents, for example, and listen to their calls to get a sense of the content of their calls.

In one example, the user can select the search object "Bob" in the system 100. In response, all the conversations that relate to Bob can attach themselves to the object representing Bob in the three-dimensional sound space. The user can then select "customer complaints," which causes an object representing the tag "customer complaint" to be introduced into the three-dimensional sound space. The conversations that have been tagged "customer complaint" can then self-arrange around the "customer complaint" tag object. Those conversations that are tagged "customer complaint" and also involve Bob can attach to both the Bob object and the "customer complaint" tag object, and group together. The user can continue to refine the search, and at the same time browse the groups to listen to the conversations in the groups. Moving close to a conversation, or dragging a conversation towards the user, for example, can result in the conversation being perceived as being closer to the user and/or louder to the user than other conversations. Moreover, the user can opt to blank out the other conversations and just listen to the specific conversation.

Embodiments within the scope of the present disclosure may also include tangible and/or non-transitory computer-readable storage media for carrying or having computer-executable instructions or data structures stored thereon. Such tangible computer-readable storage media can be any available media that can be accessed by a general purpose or special purpose computer, including the functional design of any special purpose processor as described above. By way of example, and not limitation, such tangible computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. Various modifications and changes may be made to the principles described herein without following the example embodiments and applications illustrated and described herein, and without departing from the spirit and scope of the disclosure.

We claim:

1. A method comprising:

generating, via a processor, a three-dimensional sound space having a plurality of sound sources playing at a same time, wherein each of the plurality of sound sources is assigned a respective location in a three-dimensional sound space relative to one another;

assigning a user a current location in the three-dimensional sound space relative to each respective location;

receiving an input from the user to navigate to a new location from the current location in the three-dimensional sound space; and based on the input, changing each respective location of the plurality of sound sources relative to the new location in the three-dimensional sound space.

2. The method of claim 1, wherein the three-dimensional sound space is generated based on a search request.

3. The method of claim 2, wherein the plurality of sound sources is identified based on search criteria in the search request.

4. The method of claim 1, wherein the plurality of sound sources comprises at least one of an audio playback or a live communication session, and wherein a respective playback of each of the plurality of sound sources can be automatically adjusted.

5. The method of claim 1, wherein the three-dimensional sound space is generated using three-dimensional audio spatialization, and wherein the three-dimensional sound space comprises a visual component having at least one of an image, a visual cue, or a video, the visual component being associated with at least one of the plurality of sound sources.

6. The method of claim 1, wherein each respective location is assigned to a respective sound source from the plurality of sound sources based on a relationship between the plurality of sound sources.

7. The method of claim 1, further comprising:

receiving a user selection of a sound source from the three-dimensional sound space to yield a selected sound source; and generating a new three-dimensional sound space based on sound sources related to the selected sound source.

8. The method of claim 1, wherein the input is received via at least one of a mouse, a touch screen, a touchpad, a keyboard, a camera, a photo-capture device, a voice-input device, a motion capture device, a system state, a device state, a sensor, or an external event.

9. The method of claim 1, wherein the plurality of sound sources is dynamically arranged based on groupings, wherein the groupings are based on at least one of a topic, a relevance, a search request, an association, a term, a characteristic of a sound, a respective sound associated with each of the plurality of sound sources, or content.

10. The method of claim 1, wherein the three-dimensional sound space is based on a three-dimensional particle system.

11. The method of claim 10, wherein the three-dimensional particle system is rendered via a computing device and displayed via at least one of a monitor, a tablet computer, three-dimensional glasses, a hologram projection, a smartphone, or a gaming system.

12. The method of claim 11, wherein a distance between the user and the plurality of sound sources is based on an apparent three-dimensional position of the user.

13. A system comprising:

a processor; and a computer-readable storage medium having stored therein instructions which, when executed by the processor, cause the processor to perform operations comprising:

generating, via a processor, a three-dimensional sound space having a plurality of sound sources playing at a same time, wherein each of the plurality of sound sources is assigned a respective location in a three-dimensional sound space relative to one another;

assigning a user a current location in the three-dimensional sound space relative to each respective location;

receiving an input from the user to navigate to a new location from the current location in the three-dimensional sound space; and based on the input, changing each respective location of the plurality of sound sources relative to the new location in the three-dimensional sound space.

14. The system of claim 13, wherein the three-dimensional sound space is generated based on a search request.

15. The system of claim 14, wherein the plurality of sound sources is identified based on search criteria in the search request.

16. A computer-readable device storing instructions which, when executed by a processor, cause the processor to perform operations comprising:

generating, via a processor, a three-dimensional sound space having a plurality of sound sources playing at a same time, wherein each of the plurality of sound sources is assigned a respective location in a three-dimensional sound space relative to one another;

assigning a user a current location in the three-dimensional sound space relative to each respective location;

receiving an input from the user to navigate to a new location from the current location in the three-dimensional sound space; and based on the input, changing each respective location of the plurality of sound sources relative to the new location in the three-dimensional sound space.

17. The computer-readable device of claim 15, wherein the three-dimensional sound space is generated based on a search request.

18. The computer-readable device of claim 17, wherein the plurality of sound sources is identified based on search criteria in the search request.

* * * * *